US005937866A

United States Patent [19]

Magharehi

[11] Patent Number: 5,937,866

[45] Date of Patent: Aug. 17, 1999

[54] HAIR DYE APPLICATOR

[76] Inventor: Laila Magharehi, 25032 Salford Rd., Laguna Hills, Calif. 92653

[21] Appl. No.: 09/061,945

[22] Filed: Apr. 17, 1998

[51] Int. Cl.[6] ..... A45D 24/22; B43K 7/00; B43K 7/10

[52] U.S. Cl. ..... 132/116; 132/116; 132/114; 401/209; 401/216

[58] Field of Search ..... 132/112, 116; 401/209, 216, 212, 280, 290

[56] References Cited

U.S. PATENT DOCUMENTS

| | | | |
|---|---|---|---|
| 779,936 | 1/1905 | Hodgen | 401/280 |
| 2,968,826 | 1/1961 | Leshin | 15/132.7 |
| 4,143,667 | 3/1979 | Peilet | 401/28 |
| 4,209,027 | 6/1980 | Morganroth | 132/112 |
| 4,211,247 | 7/1980 | Morganroth | 132/112 |
| 4,571,106 | 2/1986 | Scuderi | 401/209 |
| 4,602,651 | 7/1986 | Roppatte, Jr. | 132/88.5 |
| 5,067,501 | 11/1991 | Auger | 132/116 |
| 5,152,305 | 10/1992 | Niv | 132/112 |
| 5,222,822 | 6/1993 | Hernandez | 401/153 |
| 5,553,957 | 9/1996 | Dornbusch et al. | 401/209 |
| 5,709,492 | 1/1998 | Yasunaga et al. | 401/208 |

FOREIGN PATENT DOCUMENTS 559568 12/1922 France .

*Primary Examiner*—John J. Wilson
*Assistant Examiner*—Trang Doan
*Attorney, Agent, or Firm*—Curtis L. Harrington

[57] ABSTRACT

A hair dye applicator has a container having a variety of interchangeable components through which hair dye is discharged onto the hair. A first interchangeable component has a roller ball and is ideal for use when distribution of hair dye along a part at the root of the hair is desired. A second interchangeable component has a plurality of flexible brushes, and is ideal for distribution of hair dye throughout the hair and along the hair shafts. A third interchangeable component has a plurality of rigid combs, and is ideal for overall distribution of hair dye in coarse or thick hair. Both second and third interchangeable components contain a moveable disc which allows a user to control the rate of discharge of hair dye from the hair dye applicator. The hair dye applicator of the present invention has a lid that may be utilized to prevent spillage and to slow oxidation of unused hair dye which may be needed throughout the hair coloring process.

12 Claims, 3 Drawing Sheets

HAIR DYE APPLICATOR

FIELD OF THE INVENTION

The present invention relates to the field of hair dye applicators, and more particularly to a hair dye applicator which will provide an easier, cleaner method of applying hair dye.

BACKGROUND OF THE INVENTION

Historically, the application of hair dye for the purpose of changing or enhancing hair color has been a notably messy and tedious undertaking, even when performed by a professional user. Application of hair dye by a home user can be even messier and more frustrating than application of hair dye in a professional setting. Much of the reason for this messiness and potential frustration has been due to the methods available for applying the dye. Because complete and even coverage of the hair to be colored is necessary, the problem of messiness is compounded. Once the dye is applied, usually to the root of the hair where the hair is parted, it must be distributed along the scalp over the entire part in the hair. This procedure must be repeated until all of the roots have even coverage with the hair dye.

Conventional methods of applying hair dye include squeeze tubes with various sizes of openings, or use of brushes which are similar to small paint brushes. When squeeze tubes are used to apply the hair dye to the scalp and root of the hair, the user (which hereinafter may refer either to a layperson or a professional) must use a gloved hand in order to ensure that the hair dye is distributed evenly down each part of the hair. Since hair dye permanently stains anything it contacts, a user must be extremely careful both until and even after the soiled glove is removed. Once the glove is removed, it must be turned inside-out to avoid soiling surrounding surfaces. If a glove is reused after having been turned inside-out, the possibility of staining the hands is again present, thereby defeating the purpose of using a glove altogether. Since hair coloring involves a number of intermediate steps and may require a time span in excess of an hour, a gloved hand that is soiled with hair dye may prove to be a great inconvenience to the person who is applying the hair dye. The continual need for gloving and re-gloving in order to prevent contact of the skin and surrounding area with the hair dye may prove to be a great nuisance as well. Using a new glove for each step in which there is potential contact with the hair dye would prove to be somewhat costly at best.

If a paintbrush is used to apply the hair dye to the scalp at the root, complete coverage is not always achieved, and usually requires further distribution with a gloved hand in order to ensure complete and even coverage. It is apparent, then, that the problems one may encounter with this method of application are similar to those previously mentioned. Additionally, thick brushes can be difficult to clean well between applications, both in regard to sanitation between customers for professional settings, and in regard to thorough removal of all hair dye which might be embedded deep in the brush.

Both of the aforementioned methods of applying hair dye require the user to use gloved hands in order to distribute the hair dye to the shafts of the hair once the roots of the hair are processed. Again, this creates more potential for spreading hair dye to unwanted areas, hands, or clothing.

What is therefore needed is a device which will allow a user to cleanly apply and evenly distribute hair Dye to the scalp, root of the hair, and shaft of the hair while avoiding any unwanted staining of clothing, hands, or surrounding area which might occur with conventional methods of hair dye application.

SUMMARY OF THE INVENTION

The hair dye applicator of the present invention includes a container which is fittable with a variety of interchangeable applicator components and which has an accompanying lid. A roller-ball applicator component is available and is convenient for application of hair dye to the roots and scalp along a part in the hair. The roller ball applicator component may have a number of different sizes of roller balls to accommodate the hair type being colored and to aide in control of the flow of hair dye from the device. Another applicator component having brush bristles is convenient for applying hair dye either to the roots or to the hair shaft once the roots are processed. A third applicator component has rigid comb elements and is convenient for an overall application of dye to the head and hair; this component may prove quite useful in treating thick or coarse hair.

BRIEF DESCRIPTION OF THE DRAWINGS

The invention, its configuration, and its construction will be further depicted in the following detailed description, taken in conjunction with the accompanying drawings in which.

DETAILED DESCRIPTION OF THE DRAWINGS

Figure 1:
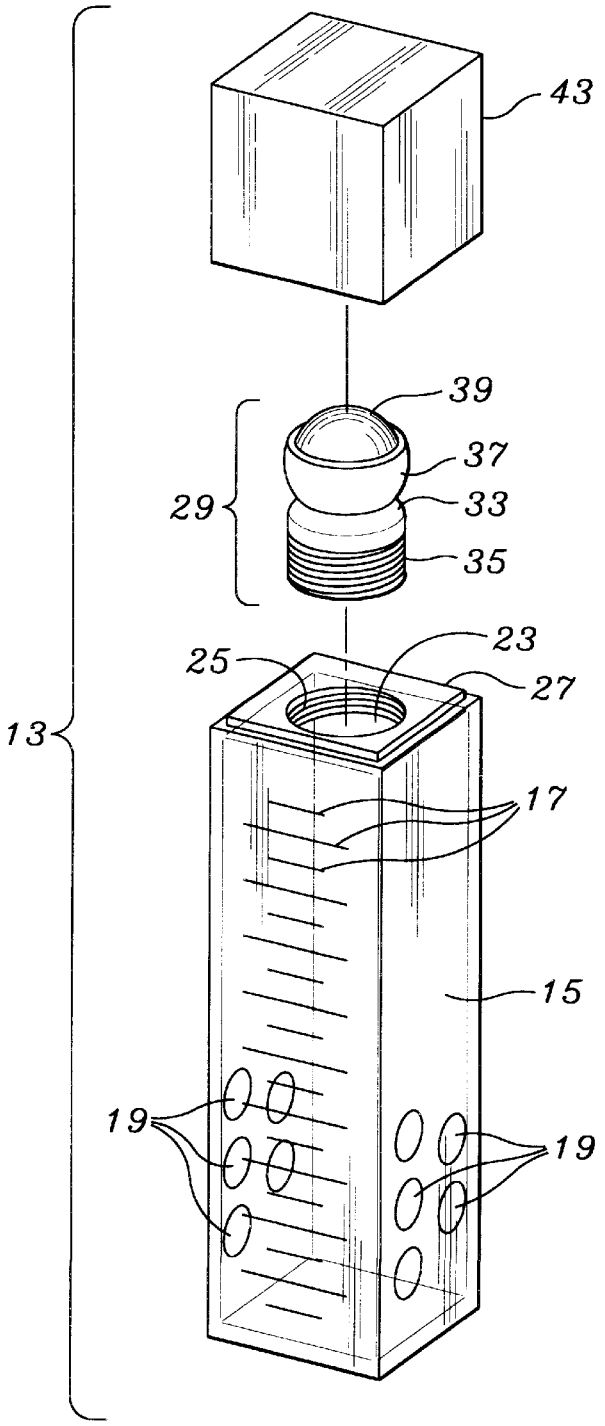
FIG. 1 is an exploded view of the hair dye applicator of the present invention and illustrates a graduated container having an aperture at its top end, a first interchangeable component having a roller ball and fittable to the container at the aperture, and a lid fittable to the container.

FIG. 1 is an exploded view of the hair dye applicator 13 of the present invention and illustrates a container 15 having graduations 17 along one side for accurate measurement of hair dye ingredients. The container 15 has a number of dimples 19 on two opposing sides so that a user may firmly grip the container 15 during application of hair dye. The container 15 has an aperture 23 at the top end having an internally threaded surface 25. Adjacent the aperture 23, the top end of the container 15 has a raised planar portion 27 having a width and length which is slightly less than the width and length of the sides of the container 15. The container 15 is preferably constructed of a transparent material which provides clear visibility and therefore lend to accurate measurement of the hair dye as it is added to or expelled from the container 15. FIG. 1 illustrates a first interchangeable component 29 adjacent the container 15 having a molded housing 33 which is hollow and which has a threaded bottom portion 35 threadable with the internally threaded surface 25 of the aperture 23 of the container 15.

The molded housing 33 of the first interchangeable component 29 has a cupped top portion 37 which loosely confines a roller ball 39. The roller ball 39 is loosely confined but moveable within the cupped top portion 37 so that fluid may escape from the container 15 by way of the first interchangeable component 29 and along the surface of the roller ball 39 when the container 15 is inverted. The first interchangeable component 29 with roller ball 39 is ideal for root application of hair dye, and allows a user to evenly distribute hair dye along the scalp and root of the hair once the hair is parted without the need for gloves. Because the roller ball 39 acts to distribute and spread the hair dye to achieve complete coverage, controlled application of hair dye using the hair dye applicator 13 with the first interchangeable component 29 decreases the possibility of staining the hands and surrounding area due to contact with hair dye. FIG. 1 illustrates a lid 43 which is press-fittable to the raised planar portion 27 of the top end of the container 15. Use of the lid 43 with the container 15 as in FIG. 2 during hair coloring will further reduce the possibility of hair dye accidentally coming in contact with hands or clothing, and will also help inhibit the oxidation process that hair dye tends to undergo upon exposure to air. Preventing oxidation of any leftover hair dye solution in the container 15 may prolong the shelf life of the hair dye solution. Preservation of the hair dye solution during hair coloring will meet any need for additional hair dye solution past the initial application. This will result in decreased waste.

Figure 2:
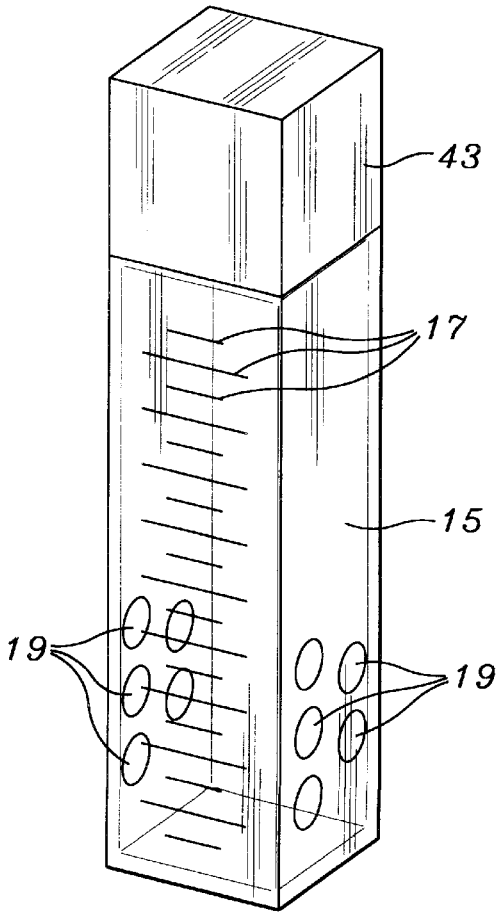
FIG. 2 is a view of the hair dye applicator of FIG. 1 which illustrates the container and lid as fitted together.

FIG. 2 illustrates the container 15 and lid 43 of the hair dye applicator 13 of the present invention as press-fitted together. The graduations 17 and dimples 19 on the container 15 are also illustrated in FIG. 2.

Figure 3:
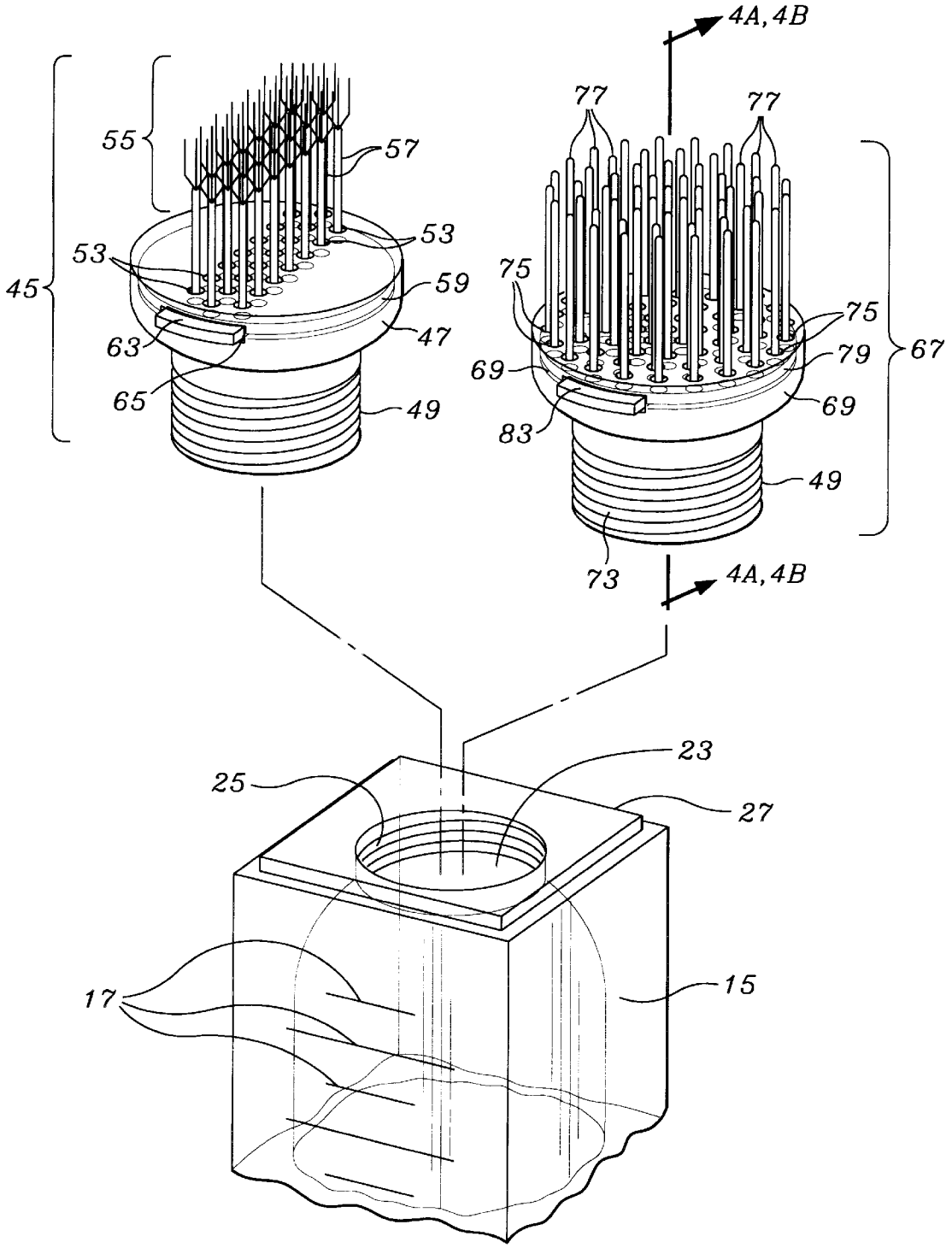
FIG. 3 is an enlarged view of the top quarter of the container and further illustrates a second interchangeable component having a plurality of brushes, and a third interchangeable component having a plurality of comb elements, both of which interchangeable components are fittable to the container at the aperture.

FIG. 3 is an enlarged view of a cutaway portion of the top quarter of the container 15 which illustrates graduations 17 on one side of the container 15. FIG. 3 clearly illustrates the raised planar portion 27 atop the container 15 which is adjacent the aperture 23 and onto which the lid 43 is fittable (refer to FIGS. 1 and 2). The internally threaded surface 25 of the aperture 23 can be seen in more detail in FIG. 3. FIG. 3 illustrates a second interchangeable component 45 having a housing 47 with a threaded bottom portion 49 threadable with the internally threaded surface 25 of the aperture 23 of the container 15. The housing 47 has a plurality of through bores 53 extending through its top end and has an approximately equal number of flexible brush elements as brush 55 fixed perpendicular to its top end and adjacent each of the plurality of through bores 53. The second interchangeable component 45 has a moveable disc 59 with a tab 63 which is positioned in a slot 65 which laterally transverses the housing 47 and which perpendicularly bisects, or interposes in the plurality of through bores 53 therein. The moveable disc 59 is used to control the flow of hair dye through the plurality of openings 23. The moveable disc 59 has a first, resting, closed position, and is manually adjustable to a second, open position (refer to FIGS. 4A and 4B). The second interchangeable component 45 is ideal for use with fine hair or sensitive scalps, and may also be used to distribute hair dye along the shaft of the hair once the root of the hair is processed.

FIG. 3 illustrates a third interchangeable component 67 having a housing 69 with a threaded bottom portion 73 threadable with the internally threaded surface 25 of the aperture 23 of the container 15. The housing 69 has a plurality of through bores 75 extending through its top end and has an approximately equal number of rigid comb structures referred to as comb 77 fixed perpendicular to its top end and adjacent each of the plurality of through bores 75. The third interchangeable component 67 has a moveable disc 79 with a tab 83 which is positioned in a slot 85 which laterally transverses the housing 69 and which perpendicularly bisects the plurality of through bores 75 therein. The moveable disc 79 is used to control the flow of hair dye through the plurality of through bores 75. The moveable disc 79 has a first, resting, closed position, and is manually adjustable to a second, open position (refer to FIGS. 4A and 4B). The third interchangeable component 67 is ideal for use with coarse or thick hair, as the rigid comb 77 will allow for ease of movement through this hair type and will ensure through coverage of the hair with the hair dye.

Figure 4B:
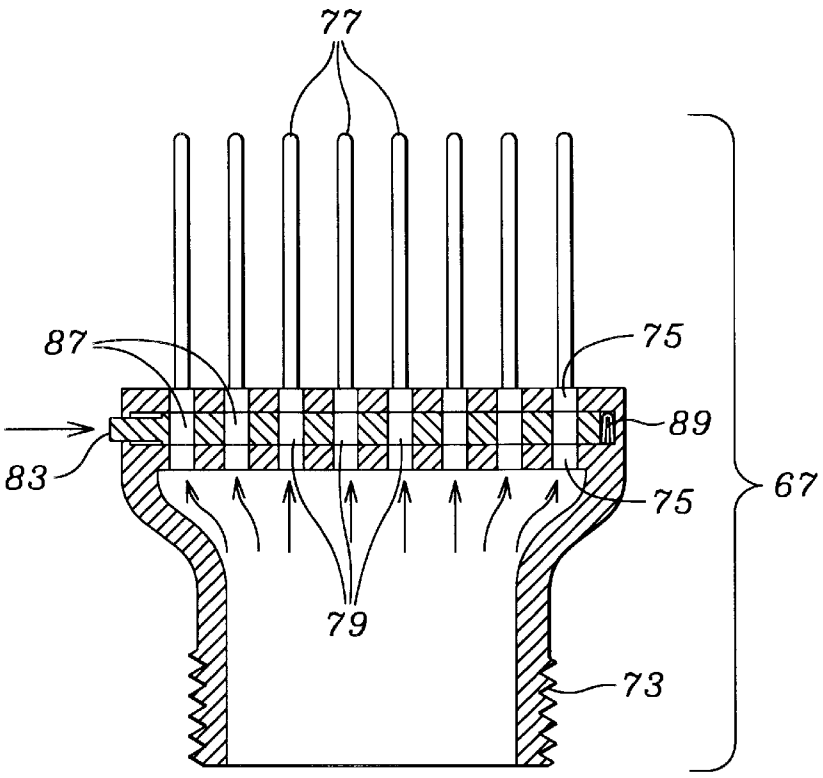
FIG. 4B is a cross-sectional view along line 4B—4B of FIG. 3 which illustrates a manually adjustable disc which controls the flow of hair dye and which is in an open position.
Figure 4A:
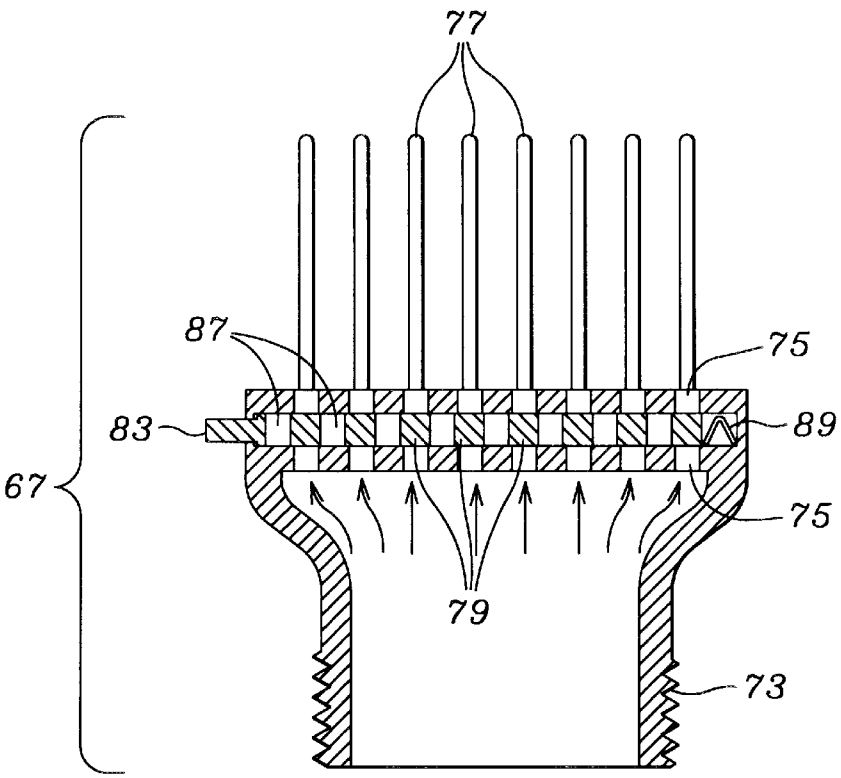
FIG. 4A is a cross-sectional view along line 4A—4A of FIG. 3 which illustrates a manually adjustable disc which controls the flow of hair dye and which is in a closed position.

FIG. 4A is a cross-sectional view along line 4A—4A of FIG. 3 which illustrates the third interchangeable component 67 with plurality of rigid comb elements to form comb 77. FIG. 4A more clearly illustrates the moveable disc 79 as located within the slot 85 which laterally transverses the housing 69 and which perpendicularly bisects the plurality of through bores 75 therein. FIG. 4A further illustrates the moveable disc 79 as also having a plurality of through bores 87 which is equal in number to the plurality of through bores 75 adjacent each of the rigid comb 77. FIG. 4A clearly illustrates the extension of the plurality of through bores 75 through the top portion of the housing 69 and bisected by the slot 85 in which the moveable disc 79 is located. FIG. 4A illustrates a tension member 89 positioned adjacent the moveable disc 79 and within the slot 85 which laterally transverses the housing 69. FIG. 4A illustrates the moveable disc 79 in a resting position, in which the plurality of through bores 87 in the moveable disc 79 are not in alignment with the plurality of through bores 75 which extend through the housing 69, thereby causing an obstruction to the flow of hair dye from the container 15 and the third interchangeable component 67.

FIG. 4B is a cross-sectional view along line 4B—4B of FIG. 3 and illustrates the third interchangeable component 67 with rigid comb 77. FIG. 4B illustrates the the moveable disc 79 in an open position. A user may manually adjust the moveable disc 79 to an open position by applying lateral force to the tab 83. The force applied to the tab 83 is transmitted through the moveable disc 79 and results in lateral movement of the disc 79 against the tension member 89. Compression of the tension member 89 allows the moveable disc 79 to advance into the slot 85 so that the plurality of through bores 75 extending through the housing 69 become aligned with the plurality of through bores 87 in the moveable disc 79, thereby forming an open passage through which the hair dye may flow when the container 15 is inverted. As the hair dye leaves the passage formed by both sets of through bores 75, 87 in alignment, it seeps along the plurality of rigid combs 77 and finally onto the hair. By this mechanism, a user may easily control the flow of hair dye, and may inhibit the flow to prevent excessive hair dye from being deposited onto the hair. Since the moveable disc 79 requires applied pressure in order for the two sets of through bores 75, 87 to align and permit free flow of hair dye, the possibility of hair dye leaking from the container 15 at inopportune times or spilling from the container 15 is greatly decreased.

Note also that the moveable disc 79 and the mechanism by which it operates is identically present in the second interchangeable component 45 as well.

The present invention may be applied in any situation where a neater, more efficient method of hair dye application is desired. Not only will the hair dye applicator of the present invention make hair dye application simpler and cleaner to perform, it may also provide a more economical route for accomplishing the task. The hair dye applicator of the present invention may be manufactured in the form of reusable applicators, or may be manufactured to be disposable for the sake of cleanliness and convenience. Although other variations on this invention may certainly occur to those skilled in the art, and those variations may be produced without departing from the spirit and scope of the invention. Therefore, included within the patent warranted hereon are all such changes and modifications as may reasonably and properly be included within the scope of this contribution to the art.

What is claimed:

1. A hair dye applicator kit comprising:

a container having a first end and a second end, said second end having a threaded aperture therein;

a first applicator component threadably attachable to said container having a first, threaded end threadable with said aperture of said container, and having a formed, second end through which said hair dye is discharged, said formed, second end loosely containing a sphere which receives said discharged hair dye, said sphere fully rotatable within said formed, second end for applying hair dye to a user's hair and scalp; and a second applicator component attachable to said container having a first end fittable to said aperture of said container, and having a second end, said second end having a plurality of flow openings through which said hair dye is discharged, and said second end having a plurality of elongate members extending from said second end, each of said plurality of elongate members closely associated with a said plurality of flow openings and where each of said plurality of elongate members are each at least one of brush or comb elements;

a flow control mechanism by which flow of said hair dye may be controlled, said flow control mechanism supported within said second applicator component, and wherein said flow control mechanism is a manually actuatable disc within said second applicator component and having a plurality of valve openings and adjustable to at least a first position where said plurality of valve openings are each completely out of alignment with its associated flow opening and to a second position, where said plurality of valve openings are each in alignment with its associated flow opening to control flow.

2. The hair dye applicator kit as recited in claim 1 wherein at least one of the sides of said container has a series of graduations thereon.

3. The hair dye applicator kit as recited in claim 2 wherein at least two opposing sides of said container have at least one indentation each thereon for individual engagement of a user's fingers to prevent slippage of said container.

4. The hair dye applicator kit as recited in claim 3 and further comprising a lid fittable to said second end of said container over one of said first and said second said threadably attachable member.

5. The hair dye applicator kit as recited in claim 4 wherein said container is constructed from a transparent material.

6. A hair dye applicator comprising:

a container having a first end and a second end, said second end having an aperture therein; and an applicator component attachable to said container having a first end fittable to said aperture of said container, and having a second end, said second end having a plurality of flow openings through which said hair dye is discharged, and said second end having a plurality of elongate members extending from said second end, each of said plurality of elongate members closely associated with a said plurality of flow openings and where each of said plurality of elongate member are each at least one of brush or comb elements a flow control mechanism by which flow of said hair dye may be controlled, said flow control mechanism supported within said applicator component, and wherein said flow control mechanism is a manually actuatable disc within said applicator component and having a plurality of valve openings and adjustable to at least a first position where said plurality of valve openings are each completely out of alignment with its associated flow opening and to a second position, where said plurality of valve openings are each in alignment with its associated flow opening to control flow.

7. The mechanism as recited in claim 6 and further comprising a tension member adjacent said disc and compressible by said disc.

8. The hair dye applicator as recited in claim 6 wherein said aperture of said container has a threaded inner surface, and wherein said first end of said applicator component further comprises threads fittable to said threaded inner surface of said aperture.

9. The hair dye applicator as recited in claim 8 wherein at least one of the sides of said container has a series of graduations thereon.

10. The hair dye applicator as recited in claim 9 wherein at least two of the sides of said container have at least one indentation each thereon.

11. The hair dye applicator as recited in claim 10 and further comprising a lid fittable to said second end of said container.

12. The hair dye applicator as recited in claim 11 wherein said container is constructed from a transparent material.

* * * * *